United States Patent [19]

Claussen et al.

[11] 4,109,305

[45] Aug. 22, 1978

[54] RELOCATABLE SUSPENDED LIGHT FIXTURE

[75] Inventors: Donald F. Claussen, Willow Street; Ronald A. Gagnon, Lancaster, both of Pa.

[73] Assignee: Armstrong Cork Company, Lancaster, Pa.

[21] Appl. No.: 679,693

[22] Filed: Apr. 23, 1976

[51] Int. Cl.[2] ..... F21S 3/00; F21V 19/02

[52] U.S. Cl. ..... 362/418; 52/28; 362/220; 362/225; 362/404

[58] Field of Search ..... 52/28, 484, 488, 64; 248/342–344, 228; 240/9 R, 51.11 R, 52 R; 362/217, 220, 225, 382, 404, 418

[56] References Cited

U.S. PATENT DOCUMENTS

| | | | |
|---|---|---|---|
| 1,923,741 | 8/1933 | Murdock et al. | 240/9 R X |
| 2,545,307 | 3/1951 | Pretzer | 248/343 X |
| 2,905,806 | 9/1959 | Tunney | 240/9 R X |
| 3,121,259 | 2/1964 | Versen | 52/28 |
| 3,181,274 | 5/1965 | Izenour | 52/484 X |
| 3,556,452 | 1/1971 | Ramsey et al. | 52/28 X |
| 3,748,793 | 7/1973 | Tompkins et al. | 52/484 X |
| 3,936,671 | 3/1976 | Bobrick et al. | 240/51.11 R X |

*Primary Examiner*—Fred L. Braun

[57] ABSTRACT

The light fixture herein can assume multi-angle relationships to the ceiling grid system within a suspended ceiling system. The light fixture is suspended from the ceiling by support posts and the support posts are movable relative the grid system of the ceiling system and the back of the light fixture to permit the light fixture to be moved to a number of different locations.

3 Claims, 5 Drawing Figures

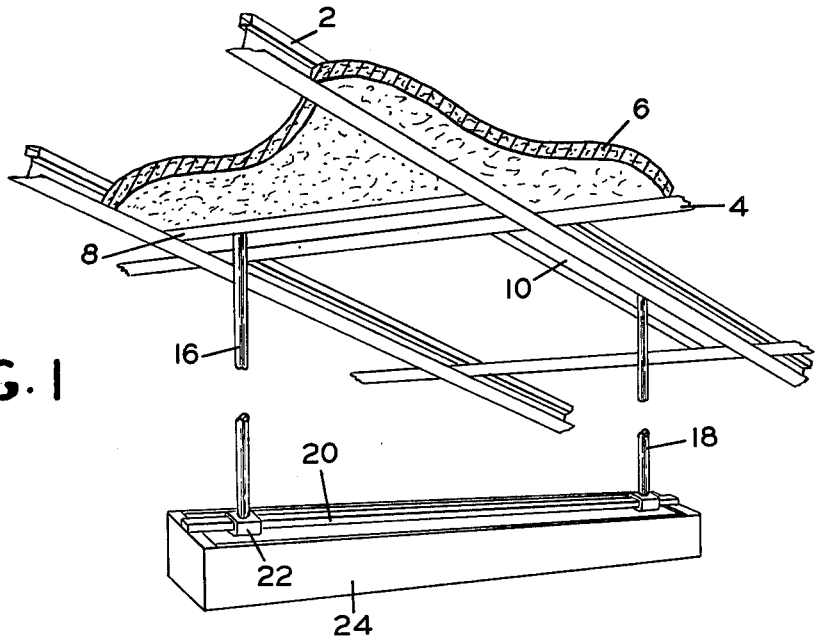
FIG. 1
FIG. 2
FIG. 5
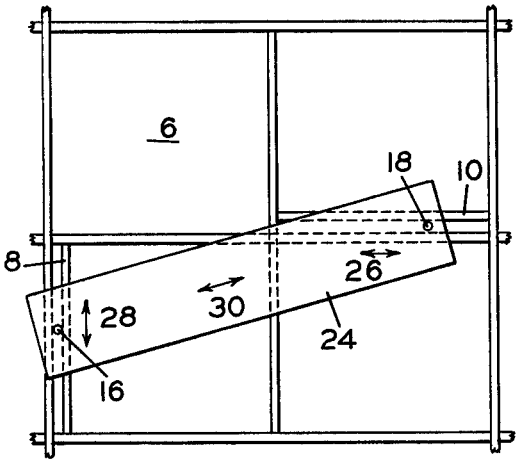
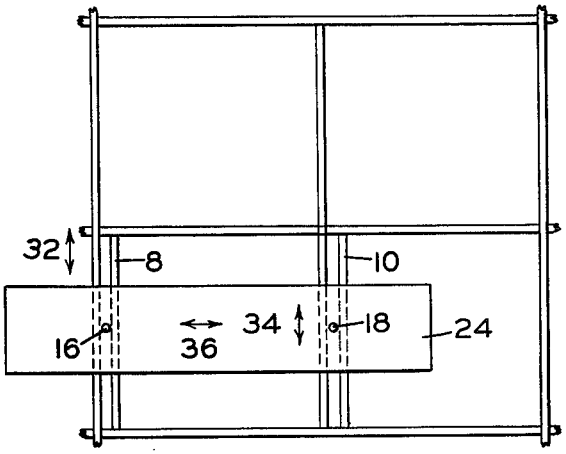
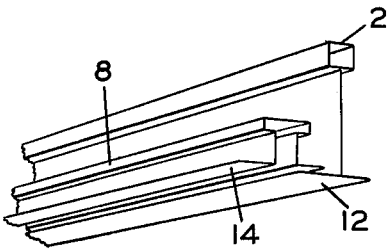
FIG. 3
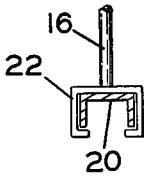
FIG. 4

RELOCATABLE SUSPENDED LIGHT FIXTURE

BACKGROUND OF THE INVENTION

1. Field of the Invention

The invention is directed to the field of illumination, and more particularly, to a light fixture for a suspended ceiling system.

2. Description of the Prior Art

U.S. Pat. No. 3,246,074 is directed to an electrical track structure for the suspended spotlight illuminator. The track structure provides power for the spotlight, and at the same time permits the relocation of the spotlight along a particular axis of movement.

U.S. Pat. No. 3,524,050 is directed to a multiple fixture lighting system using busway-mounted light fixtures including two separate sections of busway, each section having lighting fixtures mounted thereon. The sections of busway are supported at opposite ends of two adjacent parallel rows of roller type busway support hangers.

U.S. Pat. No. 2,905,806 is directed to a light suspension system which comprises at least one fixed overhead track and a second track mounted on the first-mentioned track for a rotational movement and movement along and transverse of the first-mentioned track. The second track is adapted to carry lighting equipment so as to move the same along any desired path to a selected location.

Finally, U.S. Pat. No. 3,516,343 is directed to an apparatus primarily for locating a camera at a selected position in a studio. An overhead carriage and support device is utilized involving a track structure which permits selective movement of lights to different positions.

It is believed that the prior art is totally lacking in the utilization of either two parallel or two perpendicularly positioned track elements, each of which contains one support post of a light fixture so as to enable the light fixture to be selectively relocated in a number of different positions relative a desk or other work surface below the track structure carrying the light fixture.

SUMMARY OF THE INVENTION

Specifically, the invention is directed to a permanent light fixture mounted to a ceiling grid system by twin support posts. One end of each of the posts is received in a track located on the back of the fixture, while the other end of each of the posts is received in its own support track in the ceiling grid system. At least one support track is electrified via a plug or a hard wiring connection to a power source to furnish power for operating the light fixture. Both of the support tracks are relocatable at desired positions within the ceiling grid system with the only restraint imposed on free movement being the connection to the power source. The support posts are independently slidable on both the fixture and ceiling support tracks to permit the fixture to assume a multiplicity of orientations which allow ultimate lighting of any specific location.

BRIEF DESCRIPTION OF THE DRAWING

FIG. 1 is a perspective view of a ceiling system having the light system invention herein;

FIG. 2 is a plan view of a ceiling system with the light fixture herein mounted therein;

FIG. 3 is a perspective view of a grid member and track support structure for a light fixture;

FIG. 4 is a cross-sectional view of a support post mounted on the back of a light fixture; and FIG. 5 is a plan view of another track orientation which differs from that shown in FIG. 2.

DESCRIPTION OF THE PREFERRED EMBODIMENTS

The fixture invention herein can assume multi-angle relationships to the ceiling grid system within the same plane. Traditional light fixtures can only be moved at right angles to the grid within the same plane. These multi-angled configurations are achieved by using twin support posts, one of which supplies electrical power. These posts move along a track located on the back of the light fixture. Each post then passes to its own support track segment, which is placed adjacent to the ceiling grid. These support track segments may be either parallel to each other or two segments may be positioned with one perpendicular to the other. One of the support tracks is electrified, and both tracks are movable with the suspended light fixture to a new location in the ceiling system if so desired. The electrified support track can either be plugged or hard wired into an electrical busway in the plenum. If the plug option is used, there is no limit to the distance the suspended light-ceiling track assembly can be moved between former and new locations. If the hard wire version is used, the wire connector determines the effective radius over which the electrified track, and therefore the entire lighting assembly, can be moved.

The ability of the support posts to move along both the light fixture back and the ceiling support tracks, as well as the fact that these tracks can be placed adjacent to any ceiling grid member, allows the light to assume an almost infinite number of orientations. This flexibility of movement for the light fixture allows the light assembly to be placed in the most optimum position over a given task surface, regardless of the floor plan arrangement and its relationship to the ceiling grid. The support posts also bring the light source closer to the work surface. This combination of factors allows the light output, and consequently the wattage, to be reduced to maintain a given level of illumination. The proximity of the light to the work surface also allows the use of a user activated on/off switch to be incorporated in the fixture. This is a feature which is unavailable in conventional integrated lighting/ceiling systems.

Referring now to FIG. 1, there is shown a perspective view of a suspended ceiling system with the relocatable light fixture mounted therein. A conventional suspension system 2 and 4 support ceiling boards 6 in a conventional ceiling system. Supported by the suspension system, two light tracks 8 and 10 are positioned in the ceiling system. FIG. 3 shows a conventional grid runner 2 and a light track 8. The light track simply rests upon the horizontal flange 12 of the grid member 2. The light track has a horizontal flange 14 which can then be used to support ceiling boards in the suspended ceiling system. In effect, the light track is nothing more than a conventional electric power distribution track, such as that shown in U.S. Pat. No. 3,246,074, or similar to any number of other conventional power distribution tracks which are sold in the marketplace. The light support track functions to provide power to the light fixture and at the same time suspend the light fixture.

In the invention herein, support posts 16 and 18 are supported in the light support tracks 8 and 10. One post is placed in each track. As can be seen from FIG. 1, the tracks 8 and 10 are positioned perpendicular to each other in two adjacent segments of the suspended ceiling system. The posts 16 and 18 are fastened to the back of a conventional light fixture 24.

According to FIG. 4, there is shown a cross-sectional view of the mounting of the support posts to the light fixture. The light fixture 24 is provided with a track 20 which extends the full length of the light fixture. A clip 22 on each end of the support posts 16 and 18 engages the track 20. The clip 22 is slidable along the track 20 and suspends the track 20 from the support posts 16 and 18. Track 20 in turn is fastened to the light fixture body, which carries the fluorescent tubes that provide the illumination to the work surface. The light fixture 24 is a conventional fixture in the art and could be of any particular design. Power moves from some electrical raceway above the suspended ceiling system to the light support track, from the light support track through wiring down one of the support posts to the conventional ballast of the light fixture 24.

Referring now to FIG. 2, there is shown a plan view of a conventional 2′ × 2′ panel ceiling system. Each of the panels 6 is 2′ × 2′ and four adjacent panels are shown within a conventional ceiling system. The light tracks 8 and 10 are also shown supported by the grid work of the ceiling system. The light fixture 24 is suspended from the ceiling system by the support post 16 and 18. One post 16 is mounted in light support track 8 and the second post 18 is mounted in light support track 10. The posts 16 and 18 may move along the full length of the light support tracks. In addition, the light support posts 16 and 18 slide along the back of the light fixture. Consequently, support post 18 is movable in the direction of the arrows 26 and support post 16 is movable in the direction of the arrows 28. In addition, both support posts 16 and 18 are movable in the direction of the arrows 30 along the back of the light fixture. If the support tracks are mounted as shown in FIG. 1, the light fixture is capable of movement through an arc of almost 90°. With the track arrangement shown in FIG. 2, the light fixture is capable of movement through an arc of approximately 45°. It should be noted that the light support tracks can be readily removed from the suspended ceiling system and moved to some other point within the suspended ceiling system. Consequently, the light fixture is not only movable relative to the light support tracks, but the whole assembly of the light support tracks and light fixture are also movable to other locations within a suspended ceiling system.

Referring now to FIG. 5, there is shown a ceiling system wherein the light support tracks are mounted parallel to each other. Here the support posts are movable in the direction of the arrows 32 and 34 relative to the tracks 8 and 10. In addition, the support posts are movable in the direction of the arrows 36 relative to the back of the light fixture 24. In addition to the light fixture being capable of being moved back and forth along the tracks in a position perpendicular to the tracks, the light fixture can also be moved relative to the tracks so that it is no longer perpendicular to the tracks, but at some angle relative to the parallel tracks.

What is claimed is:

1. A suspended ceiling system with relocatable lighting means, (a) said suspended ceiling system comprising:

(1) runner members with horizontal flanges forming a grid system, and (2) ceiling boards mounted on the horizontal flanges of the runner members, (b) said relocatable lighting means comprising:

(1) at least two track means, each of said track means being removably supported by a horizontal flange of at least two runner members, said track means being readily removable from one part of the ceiling system to another part of the ceiling system, each of said track means having a horizontal flange to support the edge of the ceiling board formerly supported by the horizontal flange of the runner member now supporting the track means, and (2) means for supporting a light fixture from said track means, said means for supporting the light fixture from the track means being at least two support posts, one end of each post being movably connected to the track means with the opposite ends of the support posts being connected to the light fixture.

2. A suspension system with relocatable lighting means as set forth in claim 1 wherein the support posts are movably fastened to the lighting fixture and said track means are positioned parallel to each other.

3. A suspended ceiling system with relocatable light means as set forth in claim 1 wherein the track means are positioned perpendicular to each other.

* * * * *